US008029090B2

(12) United States Patent
Numata et al.

(10) Patent No.: US 8,029,090 B2
(45) Date of Patent: Oct. 4, 2011

(54) IMAGE FORMING METHOD AND IMAGE FORMING APPARATUS

(75) Inventors: Manabu Numata, Kanagawa (JP); Hiroshi Ikeda, Kanagawa (JP); Satoshi Mohri, Kanagawa (JP); Kunichi Yamashita, Kanagawa (JP); Masatoshi Araki, Kanagawa (JP); Masashi Hiratsuka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 606 days.

(21) Appl. No.: 12/235,726

(22) Filed: Sep. 23, 2008

(65) Prior Publication Data

US 2009/0213201 A1 Aug. 27, 2009

(30) Foreign Application Priority Data

Feb. 26, 2008 (JP) ..... 2008-044011

(51) Int. Cl.
*B41J 2/01* (2006.01)

(52) U.S. Cl. ..... 347/21; 347/103

(58) Field of Classification Search ..... 347/20, 347/21, 101, 103
See application file for complete search history.

(56) References Cited

U.S. PATENT DOCUMENTS

| | | | | |
|---|---|---|---|---|
| 6,460,973 | B1 * | 10/2002 | Takahashi et al. | 347/55 |
| 6,716,562 | B2 * | 4/2004 | Uehara et al. | 430/125.3 |
| 7,887,177 | B2 * | 2/2011 | Doi et al. | 347/103 |
| 2001/0022607 | A1 | 9/2001 | Takahashi et al. | |
| 2006/0284951 | A1 * | 12/2006 | Ikeda et al. | 347/103 |

FOREIGN PATENT DOCUMENTS

| | | |
|---|---|---|
| JP | 7-89067 | 4/1995 |
| JP | 11-188858 | 7/1999 |
| JP | 2001-347747 | 12/2001 |
| JP | 2006-347081 | 12/2006 |

* cited by examiner

*Primary Examiner* — Huan Tran
(74) *Attorney, Agent, or Firm* — Fildes & Outland, P.C.

(57) ABSTRACT

An image forming method including: forming a liquid receiving particle layer on an intermediate transfer member using a liquid receiving particle that is capable of receiving a recording liquid including a recording material; forming an image of the recording material on a surface of the liquid receiving particle layer by applying a liquid droplet of the recording liquid to the liquid receiving particle layer on the basis of image data and holding the recording material on the surface of the liquid receiving particle layer on the intermediate transfer member; applying a transfer auxiliary liquid in at least a portion of a formation range of the image; and transferring the liquid receiving particle layer to which the recording liquid is applied to a transfer receiving member from the intermediate transfer member, such that the image is interposed between the transfer receiving member and the liquid receiving particle layer is provided.

14 Claims, 14 Drawing Sheets

| INK | | AUXILIARY LIQUID |
|---|---|---|
| NONE | NONE | NONE |
| SMALL DROPLET | SINGLE COLOR | MEDIUM DROPLET |
| MEDIUM DROPLET | SECONDARY COLOR | SMALL DROPLET |
| LARGE DROPLET | TERTIARY COLOR | NONE |

| INK | AUXILIARY LIQUID |
|---|---|
| NONE | LARGE DROPLET |
| SMALL DROPLET | MEDIUM DROPLET |
| MEDIUM DROPLET | SMALL DROPLET |
| LARGE DROPLET | NONE |

FIG. 9

| INK | AUXILIARY LIQUID |
|---|---|
| NONE | LARGE DROPLET |
| SMALL DROPLET | LARGE DROPLET |
| MEDIUM DROPLET | LARGE DROPLET |
| LARGE DROPLET | LARGE DROPLET |

FIG. 10

| IMAGE INFORMATION | INK | P INK |
|---|---|---|
| 0 | NONE | NONE |
| 1 TO 31 | NONE | MEDIUM DROPLET |
| 32 TO 63 | NONE | LARGE DROPLET |
| 64 TO 95 | SMALL DROPLET | SMALL DROPLET |
| 96 TO 127 | SMALL DROPLET | MEDIUM DROPLET |
| 128 TO 159 | SMALL DROPLET | LARGE DROPLET |
| 160 TO 191 | MEDIUM DROPLET | NONE |
| 192 TO 223 | MEDIUM DROPLET | MEDIUM DROPLET |
| 224 TO 255 | LARGE DROPLET | NONE |

FIG. 11

| | EMBODIMENT 1 | EMBODIMENT 2 | EMBODIMENT 3 | EMBODIMENT 4 | EMBODIMENT 5 | COMPARATIVE EXAMPLE |
|---|---|---|---|---|---|---|
| ART PAPER | ○ | ○ | ○ | ○ | ○ | × |
| C2 PAPER | △ | ○ | ○ | ○ | △ | × |
| LEATHEK 66 | × | ○ | ○ | ○ | × | × |

IMAGE FORMING METHOD AND IMAGE FORMING APPARATUS

CROSS-REFERENCE TO RELATED APPLICATION

This application is based on and claims priority under 35 USC 119 from Japanese Patent Application No. 2008-044011 filed Feb. 26, 2008.

BACKGROUND

Technical Field

The present invention relates to an image forming method and an image forming apparatus and more particularly relates to an image forming method and an image forming apparatus according to an intermediate transfer type recording system that performs image recording by liquid droplets on the surface of an intermediate transfer member and thereafter transfers the image to a recording medium to record the image on the surface of the recording medium.

SUMMARY

According to an aspect of the present invention is an image forming method including: forming a liquid receiving particle layer on an intermediate transfer member using a liquid receiving particle that is capable of receiving a recording liquid including a recording material; forming an image of the recording material on a surface of the liquid receiving particle layer by applying a liquid droplet of the recording liquid to the liquid receiving particle layer on the basis of image data and holding the recording material on the surface of the liquid receiving particle layer on the intermediate transfer member; applying a transfer auxiliary liquid in at least a portion of a formation range of the image; and transferring the liquid receiving particle layer to which the recording liquid is applied to a transfer receiving member from the intermediate transfer member, such that the image is interposed between the transfer receiving member and the liquid receiving particle layer.

BRIEF DESCRIPTION OF THE DRAWINGS

Exemplary embodiments of the invention will be described in detail with reference to the following figures, wherein:

FIG. 9 is a chart showing the relationship between liquid amounts of liquid droplets and auxiliary liquid droplets in image formation pertaining to a fourth exemplary embodiment of the invention;

FIG. 10 is a chart showing the relationship between liquid amounts of liquid droplets and liquid amounts of auxiliary liquid droplets (pale ink) in image formation pertaining to a fifth exemplary embodiment of the invention;

FIG. 11 is a chart showing the effect of transfer defect reduction in image formation pertaining to the first to fifth exemplary embodiments of the invention;

DETAILED DESCRIPTION

<Apparatus Overall>

First, an image forming apparatus 10 relating to a first exemplary embodiment of the present invention will be described overall.

Figure 1:
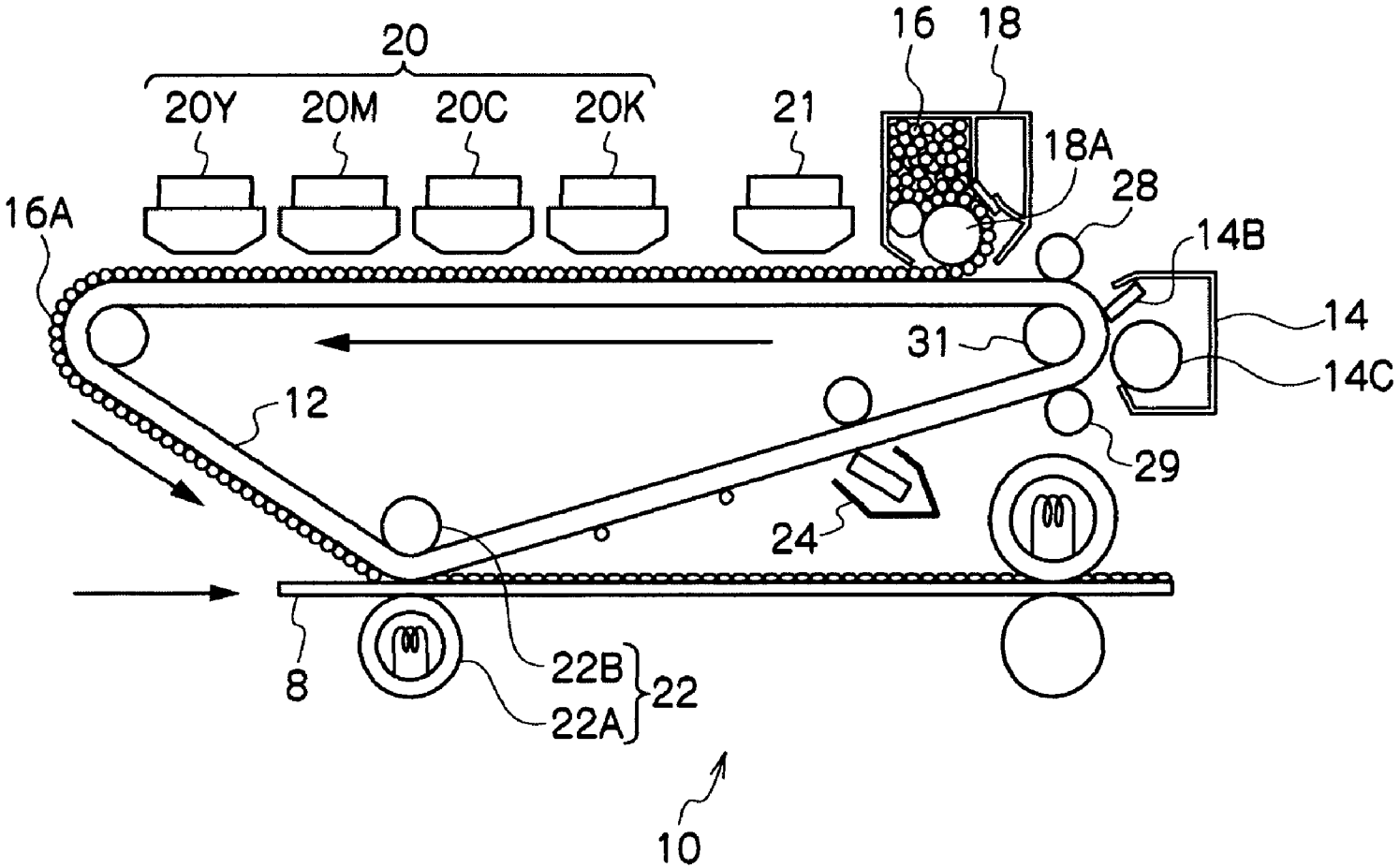
FIG. 1 is a conceptual drawing showing an image forming apparatus pertaining to the invention.

In FIG. 1, there is shown the image forming apparatus 10 pertaining to the first exemplary embodiment of the present invention.

As shown in FIG. 1, the image forming apparatus 10 of the present invention is configured to include an endless belt-like intermediate transfer member 12, a charging device 28 that charges the surface of the intermediate transfer member 12, a particle application device 18 that causes liquid receiving particles 16 to adhere uniformly and with a constant thickness to a charged region on the intermediate transfer member 12 to form a particle layer, an auxiliary liquid droplet ejecting head 21 that ejects auxiliary liquid droplets onto the particle layer to adjust the moisture amount of the particle layer, liquid droplet ejecting heads 20 that eject liquid droplets onto the particle layer to form an image, and a transfer-fixing device 22 that superposes a recording medium 8 on the intermediate transfer member 12 and transfers and fixes the liquid receiving particle layer 16A onto the recording medium 8 by applying pressure and heat thereto.

On the upstream side of the charging device 28, there is disposed a release agent application device 14 that forms a release layer 14A (see FIG. 2A) for promoting release of the liquid receiving particle layer 16A from the surface of the intermediate transfer member 12 in order to improve the transfer efficiency of the liquid receiving particle layer 16A from the surface of the intermediate transfer member 12 to the recording medium 8. On the surface of the intermediate transfer member 12 on which a charge has been formed by the charging device 28, the liquid receiving particles 16 are formed as a uniform layer by the particle application device 18.

In the present exemplary embodiment, the auxiliary liquid droplet ejecting head 21 is disposed in a position facing the intermediate transfer member 12 that adds an auxiliary liquid to this particle layer for the purpose of causing the particle layer to include moisture that is necessary to impart sufficient tackiness to transfer in a later step.

Next, the liquid droplets 20A of respective colors are ejected onto the particle layer from the liquid droplet ejecting heads 20 of each color, that is, 20K, 20C, 20M and 20Y, and a color image is formed.

The particle layer 16A on whose surface the color image has been formed is transferred per color image to the recording medium 8 by the transfer-fixing device 22 together with the color image. On the downstream side of the transfer-fixing device 22, there is disposed a cleaning device 24 for performing removal of the liquid receiving particles 16 (residual particles 16D) that remain on the surface of the intermediate transfer member 12 and removal of foreign matter (paper dust of the recording medium 8, etc.) other than the particles such as matter adhering to the intermediate transfer member 12.

The recording medium 8 to which the color image has been transferred is transported out as is, and a charge is again formed by the charging device 28 on the surface of the intermediate transfer member 12. At this time, the liquid receiving particles 16 that have been transferred to the recording medium 8 absorb/hold the liquid droplets 20A, so capable of being transported speedily, and the productivity of the apparatus overall can be raised in comparison to a conventional method where the recording medium 8 is caused to absorb a liquid.

Further, a charge eraser (a charge removal unit) 29 that erases the charge that remains on the surface of the intermediate transfer member 12 may also be disposed as needed between the cleaning device 24 and the release agent application device 14. The intermediate transfer member 12 is circulatingly transported and, first, the release layer 14A is formed on the surface of the intermediate transfer member 12 by the release agent application device 14. A release agent 14D is applied to the surface of the intermediate transfer member 12 by an application roller 14C of the release agent application device 14, and the layer thickness is defined by a blade 14B.

At this time, in order to ensure that image formation and printing can be continuously performed, the release agent application device 14 may be configured to continuously contact the intermediate transfer member 12 or be configured to appropriately be apart from the intermediate transfer member 12. Further, the release agent 14D may be supplied to the application device from an independent liquid supply system (not shown) such that supply of the release agent 14D is not interrupted.

Next, the surface of the intermediate transfer member 12 is charged with a positive charge as a result of a positive charge being applied to the surface of the intermediate transfer member 12 by the charging device 28. Here, an electric potential by which the liquid receiving particles 16 are capable of being supplied/attracted to the surface of the intermediate transfer member 12 by electrostatic force resulting from an electric field that can be formed between a supply roll 18A of the particle application device 18 and the surface of the intermediate transfer member 12, may be formed.

Further, the charging device 28 may be configured by a corotron and/or a brush. Application of voltage in this case is also performed under substantially the same condition as what has been described above. In particular, a corotron is capable of applying a charge to, without contacting, the intermediate transfer member 12.

Next, the liquid receiving particles 16 are supplied to the surface of the intermediate transfer member 12 by the particle application device 18 to form the liquid receiving particle layer 16A. In the particle application device 18, the supply roll 18A is disposed in a portion of a container in which the liquid receiving particles 16 are housed that faces the intermediate transfer member 12, and a charging blade 18B is disposed so as to push against the developing roller 16. This charging blade 18B also has the function of regulating the layer thickness of the liquid receiving particles 16 that adhere to the surface of the supply roll 18A.

The liquid receiving particles 16 are supplied to the supply roll 18A (conductive roll), and the liquid receiving particle layer 16A is regulated by the charging blade 18B and charged negatively which is the opposite polarity of the charge of the surface of the intermediate transfer member 12. For the supply roll 18A, a solid roll made of aluminum can be used, and for the charging blade 18B, a metal plate (SUS or the like) to which urethane rubber is attached can be used in order to apply pressure. The charging blade 18B contacts the supply roll 18A by the doctor system.

The charged liquid receiving particles 16 form substantially single particle layer, for example, on the supply roll 18A and are transported to a site facing the surface of the intermediate transfer member 12. When the charged liquid receiving particles 16 approach this site, the charged liquid receiving particles 16 move to the surface of the intermediate transfer member 12 by electrostatic force due to the electric field that has been formed by the difference in electric potential between the supply roll 18A and the surface of the intermediate transfer member 12.

Next, the auxiliary liquid droplet ejecting head 21 adds, as described later, the auxiliary liquid droplets 21A to the liquid receiving particle layer 16A that has the liquid receiving particles 16.

Next, the liquid droplet ejecting heads 20 apply the liquid droplets 20A to the liquid receiving particle layer 16A. The liquid droplet ejecting heads 20 apply the liquid droplets 20A to predetermined positions on the basis of predetermined image information. Finally, the liquid receiving particle layer 16A is transferred onto the recording medium 8 due to pressure and heat being applied to the liquid receiving particle layer 16A by the transfer-fixing device 22 with the recording medium 8 and the intermediate transfer member 12 being interposed therebetween.

The transfer-fixing device 22 is configured by a heat roll 22A that houses a heating source and a pressure roll 22B that faces the heat roll 22A with the intermediate transfer member 12 being interposed therebetween. The heat roll 22A and the pressure roll 22B contact each other and form a nip. For the heat roll 22A and the pressure roll 22B, similar to an electrophotographic fixer (fuser), the roll including an aluminum core whose outer surface is covered with silicone rubber and is further covered with a PFA tube can be used.

In the nip portion of the heat roll 22A and the pressure roll 22B, the liquid receiving particle layer 16A is heated by a heater and pressure is applied thereto, whereby the liquid receiving particle layer 16A is transferred, and at the same time is fixed, to the recording medium 8.

Figure 2A:
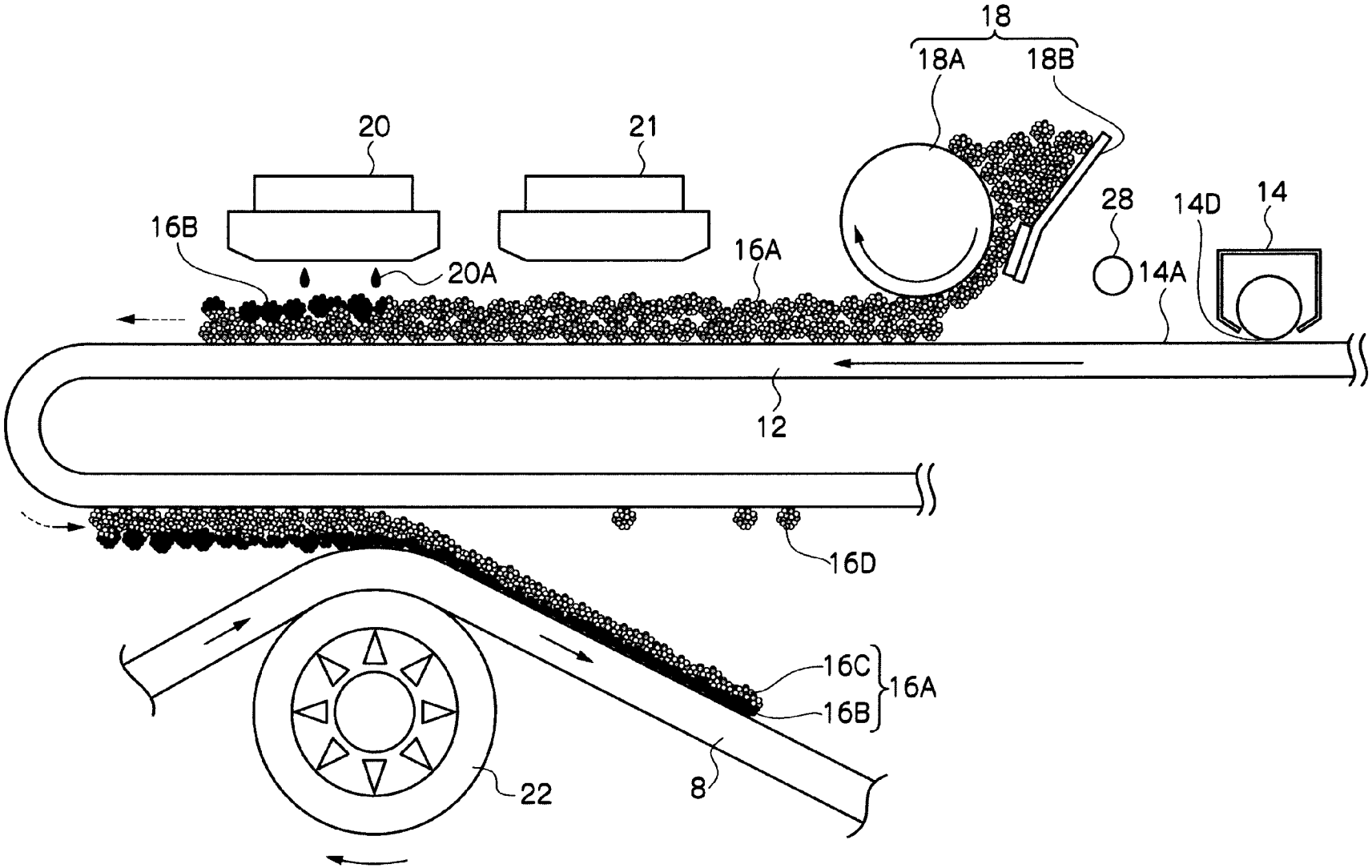
FIGS. 2A and 2B are enlarged drawings showing part of the image forming apparatus shown in FIG. 1.

In FIG. 2A, there is shown the process of image formation relating to the first exemplary embodiment of the present invention.

As shown in FIG. 2A, the release layer 14A is formed on the surface of the intermediate transfer member 12 by the release agent application device 14 in order to ensure releasability when transfer and prevent the adhesion of the liquid receiving particles 16 being prevented resulting from the adhesion of moisture to the surface. In a case in which the material of the intermediate transfer member 12 is aluminum or a PET base, the effect of the release layer 14A is large. Alternatively, releasability may also be imparted to the surface itself of the intermediate transfer member 12 by using a fluorocarbon resin/silicone rubber material. It will be noted that, as shown in FIG. 2A, the image forming apparatus 10 may also be configured such that the intermediate transfer member 12 is linearly transported and such that the recording medium 8 is pushed against the intermediate transfer member 12.

Next, the surface of the intermediate transfer member 12 is charged by the charging device 28 to the opposite polarity of that of the liquid receiving particles 16. Thus, the liquid receiving particles 16 that are supplied by the supply roll 18A of the particle application device 18 are electrostatically attracted to the intermediate transfer member 12 such that a uniform layer of the liquid receiving particles 16 can be formed on the surface of the intermediate transfer member 12.

Next, the liquid receiving particles 16 are formed as a uniform layer by the supply roll 18A of the particle application device 18 on the surface of the intermediate transfer member 12. For example, the liquid receiving particle layer 16A is formed so as to have a thickness where about three layers of the liquid receiving particles 16 are superposed. That is, the particle layer 16A is controlled to be a desired thickness by a clearance between the charging blade 18B and the supply roller 18A, whereby the thickness of the particle layer 16A that is to be transferred to the recording medium 8 is controlled. Alternatively, the thickness of the particle layer 16A may also be controlled by the circumferential velocity ratio of the supply roller 18A and the intermediate transfer member 12.

Figure 2B:
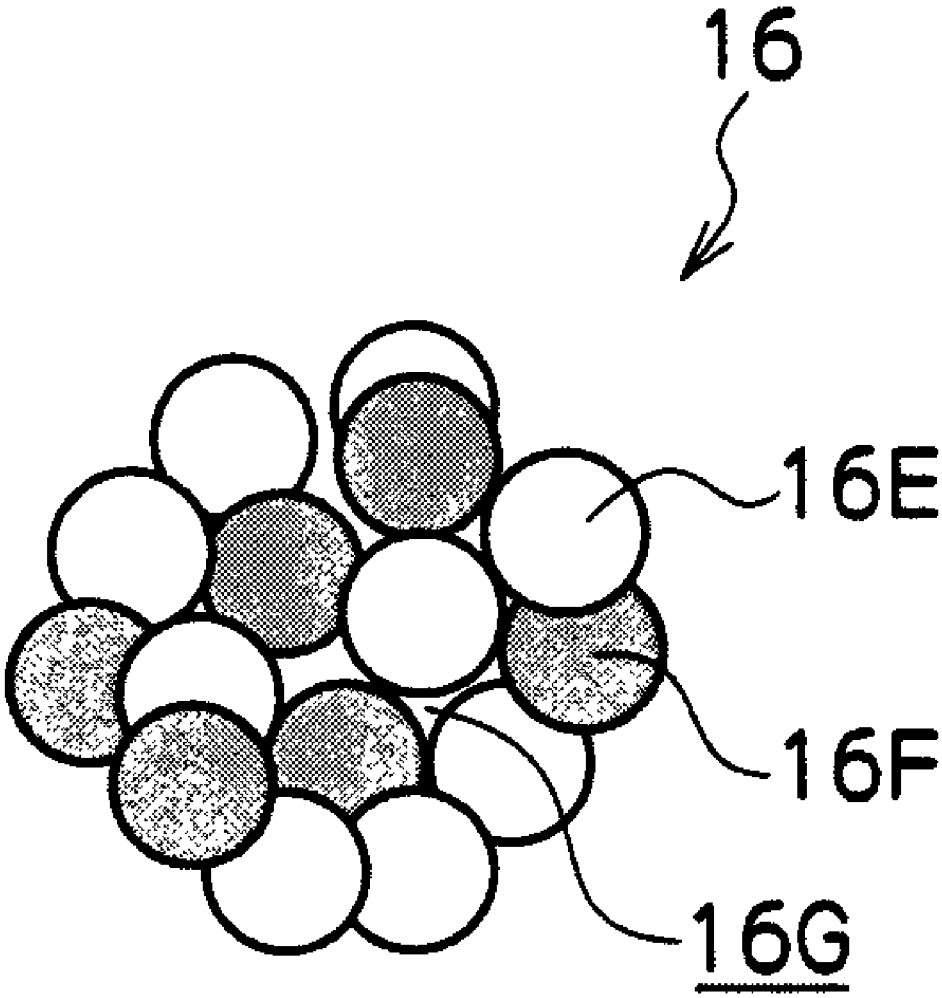

Here, the structure of the liquid receiving particle 16 is, as shown in FIG. 2B, is a secondary particle preferably with a diameter of 2 to 3 μm, for example, such that fixing particles 16E and porous particles 16F are agglutinated/granulated with spaces 16G therebetween.

The liquid droplets 20A are ejected onto the formed particle layer 16A by the liquid droplet ejecting heads 20 of each color that are driven by a piezoelectric system, a thermal system or the like, and an image layer 16B is formed on the particle layer 16A. The liquid droplets 20A that have been ejected from the liquid droplet ejecting heads 20 are driven into the liquid receiving particle layer 16A, an ink is speedily absorbed due to the spaces 16G formed in the liquid receiving particle 16, a solvent is sequentially absorbed by the pores in the porous particles 16F and by the fixing particles 16E, and a pigment (color material) is held on the surfaces of primary particles (the fixing particles 16E and the porous particles 16F) that form the liquid receiving particle 16.

The pores in the primary particles that configure the secondary particle exhibit a filter effect, the pigment in the ink is held in the vicinity of the surface portion of the particle layer, and is held on and fixed to the surfaces of the primary particles, whereby a lot of the pigment can be held in the vicinity of the surface of the liquid receiving particle layer 16A.

Further, it is more preferable to employ a method which, in order for the pigment to be reliably held in the vicinity of the surface of the liquid receiving particle layer 16A and on the surfaces of the primary particles, speedily insolubilizes (aggregates) the pigment by causing the liquid droplets 20A and the liquid receiving particles 16 to react.

The solvent after the pigment has been held penetrates in the particle layer depth direction, is absorbed by the pores in the porous particles 16F and by the fixing particles 16E, and is held in the spaces 16G between the particles. Further, the fixing particles 16E that have absorbed the ink solvent soften, whereby contributing to transfer-fixing. For this reason, even when the liquid receiving particle layer 16A advances to the next liquid droplet ejecting head 20 and the liquid droplets 20A of the next color are ejected, a phenomenon where the liquid droplets 20A mix together and bleeding occurs can be suppressed.

At this time, the solvent or dispersing medium included in the ink droplets 20A penetrates the particle layer 16A, but the recording material such as the pigment is held in the vicinity of the surface of the particle layer 16A. That is, the solvent or the dispersing medium may penetrate as far as the undersurface of the particle layer 16A, but the recording material such as the pigment does not penetrate to the undersurface of the particle layer 16A. Thus, when transferred to the recording medium 8, a particle layer 16C to which the recording material such as the pigment has not penetrated forms a layer on the image layer 16B, so this particle layer 16C becomes a protective layer that seals the surface of the image layer 16B.

Next, a color image is formed on the recording medium 8 as a result of the particle layer 16A in which the image layer 16B has been formed being transferred/fixed onto the recording medium 8 from the intermediate transfer member 12. The particle layer 16A on the intermediate transfer member 12 is heated/pressurized by the transfer-fixing device 22 that has been heated by heating means such as a heater and is transferred onto the recording medium 8. Fixing of the fixing particles 16F is performed as a result of the fixing particles 16F themselves each other, and the fixing particles 16F and the recording medium 8, being joined together by pressure and/or heat.

The residual particles 16D that remain on the surface of the intermediate transfer member 12 after the particle layer 16A has been released therefrom are collected by the cleaning device 24 in FIG. 1, the surface of the intermediate transfer member 12 is again charged by the charging device 28, the liquid receiving particles 16 are supplied, and the particle layer 16A is formed.

<Auxiliary Liquid Adding Process>

As shown in FIG. 2A, the liquid receiving particle layer 16A is transferred from the intermediate transfer member 12 to the recording medium 8 in the subsequent process. At this time, in a case in which the liquid amount of the liquid droplet 20A that is ejected onto the liquid receiving particle layer 16A from the liquid droplet ejecting head 20 is small (when the liquid droplet is small), there is the potential for sufficient tackiness to not be imparted and for transferability to the recording medium 8 to be insufficient due to the amount of moisture that the liquid receiving particle 16 absorbs being insufficient.

For this reason, the problem of transferability can be solved by that, depending on the liquid amount of the liquid droplet 20A, at the image forming apparatus 10 the auxiliary liquid droplet 20A is ejected from the auxiliary liquid droplet ejecting head 21, and the liquid droplet 20A is ejected onto the same dot to maintain the liquid amount overall equal to or greater than a constant so that the liquid receiving particle 16 absorbs a sufficient amount of moisture.

Figures 3A, 3B:
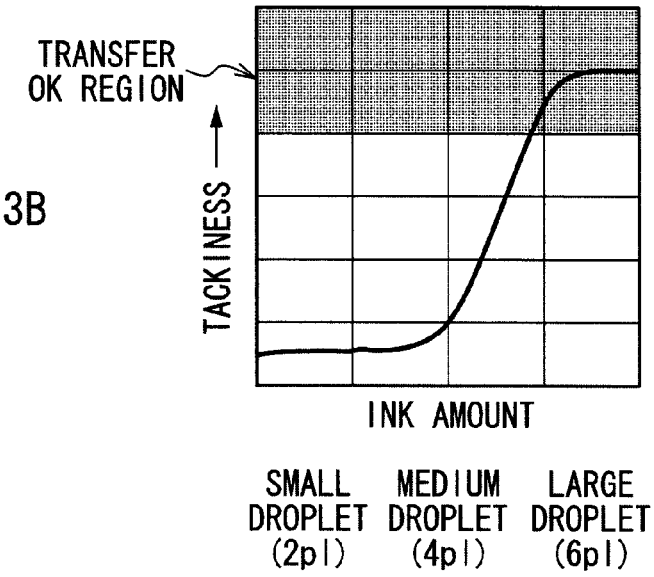
FIGS. 3A and 3B are a chart and a graph showing the relationship between liquid amounts of liquid droplets and tackiness in image formation pertaining to a first exemplary embodiment of the invention.

In FIG. 3A and FIG. 3B, there is shown the relationship between liquid amount of the liquid droplet 20A (ink), liquid amount of the auxiliary liquid droplet 21A and tackiness.

For example, as shown by the left side of the chart in FIG. 3A, a method is already known which, when expressing gradation by changing the size of the liquid droplet 20A in ink of the same color, controls the liquid amount as in small diameter is 2 pl, medium diameter is 4 pl and large diameter is 6 pl, for example, to change the size of the liquid droplet 20A.

However, the liquid amount becomes small in a dot where small diameter liquid droplet 20A is ejected in order to represent a small dot, so when transfer from the intermediate transfer member 12 to the recording medium 8, there is the potential for sufficient tackiness to not be imparted because the amount of moisture that the liquid receiving particle 16 absorbs is insufficient and for this to cause transfer defects as described above.

Figure 4:
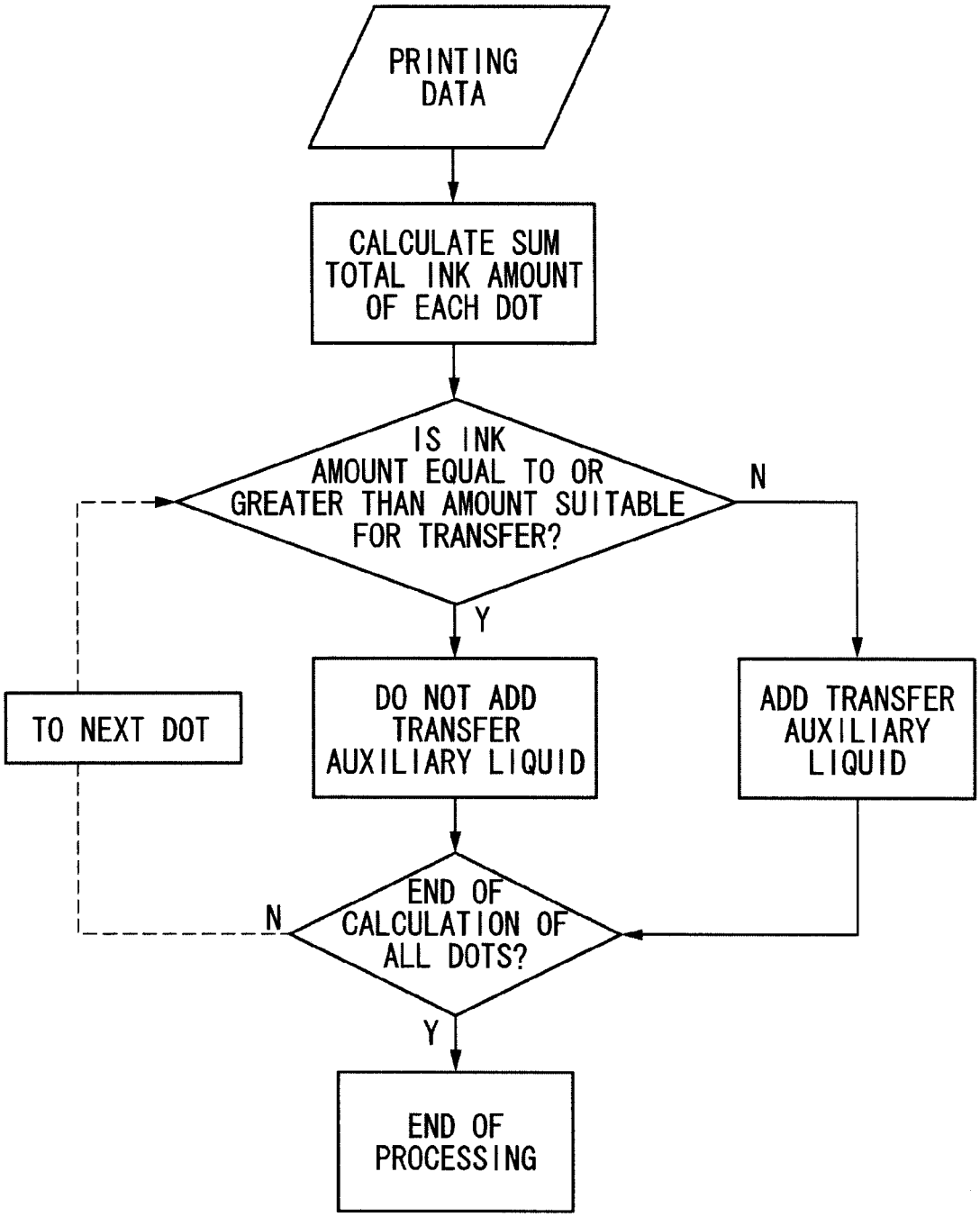
FIG. 4 is a flowchart of transfer auxiliary liquid amount calculation in image formation pertaining to the first exemplary embodiment of the invention.

Thus, in accordance with the procedure shown in the flowchart in FIG. 4, as shown in FIG. 3A, the control of the liquid amount is performed such that a medium diameter (4 pl) auxiliary droplet 21A is ejected beforehand onto a dot where a small diameter (2 pl) liquid droplet 20A is to be ejected and a small diameter (2 pl) auxiliary droplet 21A is similarly ejected onto a dot where a medium diameter (4 pl) liquid droplet 20A is to be ejected, whereby both the small diameter and medium diameter dots become a dot with the same liquid amount (amount of moisture) as a large diameter (6 pl) dot, and transfer defects resulting from an insufficient amount of moisture can be prevented.

That is, as shown in FIG. 3B, by adding the auxiliary liquid droplet 21A to both small diameter and medium diameter dots, the dots can be given a liquid amount for a transfer OK region having sufficient tackiness.

Further, the above-described method is a control method that is applicable both to image formation of a single color and a full color, in a case of full color image formation using the liquid droplets 20A of three colors whose droplet diameters are constant, for example, as shown in FIG. 3A, the method may also control the liquid amount with the numbers of superposed colors rather than by the liquid amount of the liquid droplet 20A.

That is, by making the droplet diameter 2 pl in the case of a primary color (single color), 4 pl in the case of a secondary color, and 6 pl in the case of a tertiary color, 4 pl auxiliary droplet 21A is added to a dot of a single color and 2 pl auxiliary droplet 21A is added to a dot of a secondary color, so that the liquid amount can always be made the same liquid amount as that of a tertiary color (6 pl), and transfer defects resulting from an insufficient amount of moisture can be prevented.

Second Exemplary Embodiment

As described above, in the first exemplary embodiment of the present invention, depending on the liquid amount of the liquid droplet 20A, the image forming apparatus 10 performs control to eject the auxiliary liquid droplet 21A, and the liquid droplet 20A is ejected onto the same dot to maintain the liquid amount of the dot overall equal to or greater than a constant such that the liquid receiving particle 16 absorbs a sufficient amount of moisture.

In contrast, rather than increasing the liquid amount on the same dot, the size (number of pixels) of the dot that the liquid penetrates may be increased so that, even though the liquid amount per unit area is small, transferability can also be improved by widening the area of contact with the recording medium 8 per dot.

Figure 5A:
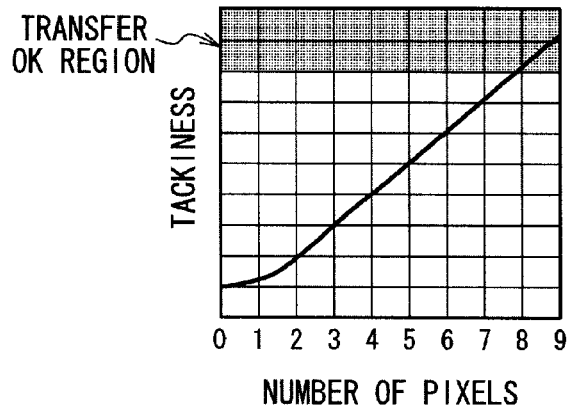
FIGS. 5A and 5B are a chart and a graph showing the relationship between numbers of pixels and tackiness in image formation pertaining to a second exemplary embodiment of the invention.

In FIG. 5A, there is shown the relationship between tackiness and the number of pixels per dot of the ink (the liquid droplet 20A) in an image forming method pertaining to a second exemplary embodiment of the present invention. As shown by the chart in FIG. 5A, by increasing the number of pixels that form one dot, the area of one dot becomes larger, tackiness to the recording medium 8 improves, and transfer defects can be prevented.

Figure 5B:
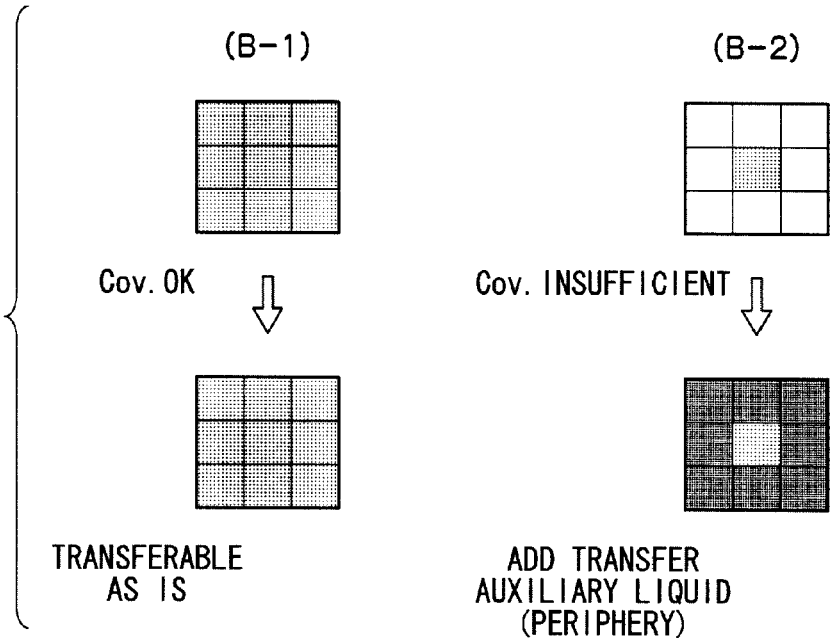

That is, for example, as shown in FIG. 5B, B-1, when considering a case using the recording medium 8 where transferability is OK (good) in a case in which the dot is a dot that is configured by 3×3 pixels. In this case, even if tackiness per pixel is OK, however, depending on the width/depth of surface unevenness of the recording medium 8, a case is conceivable in which the pixel is not transferred because the pixel does not contact the recording medium 8.

Figure 6:
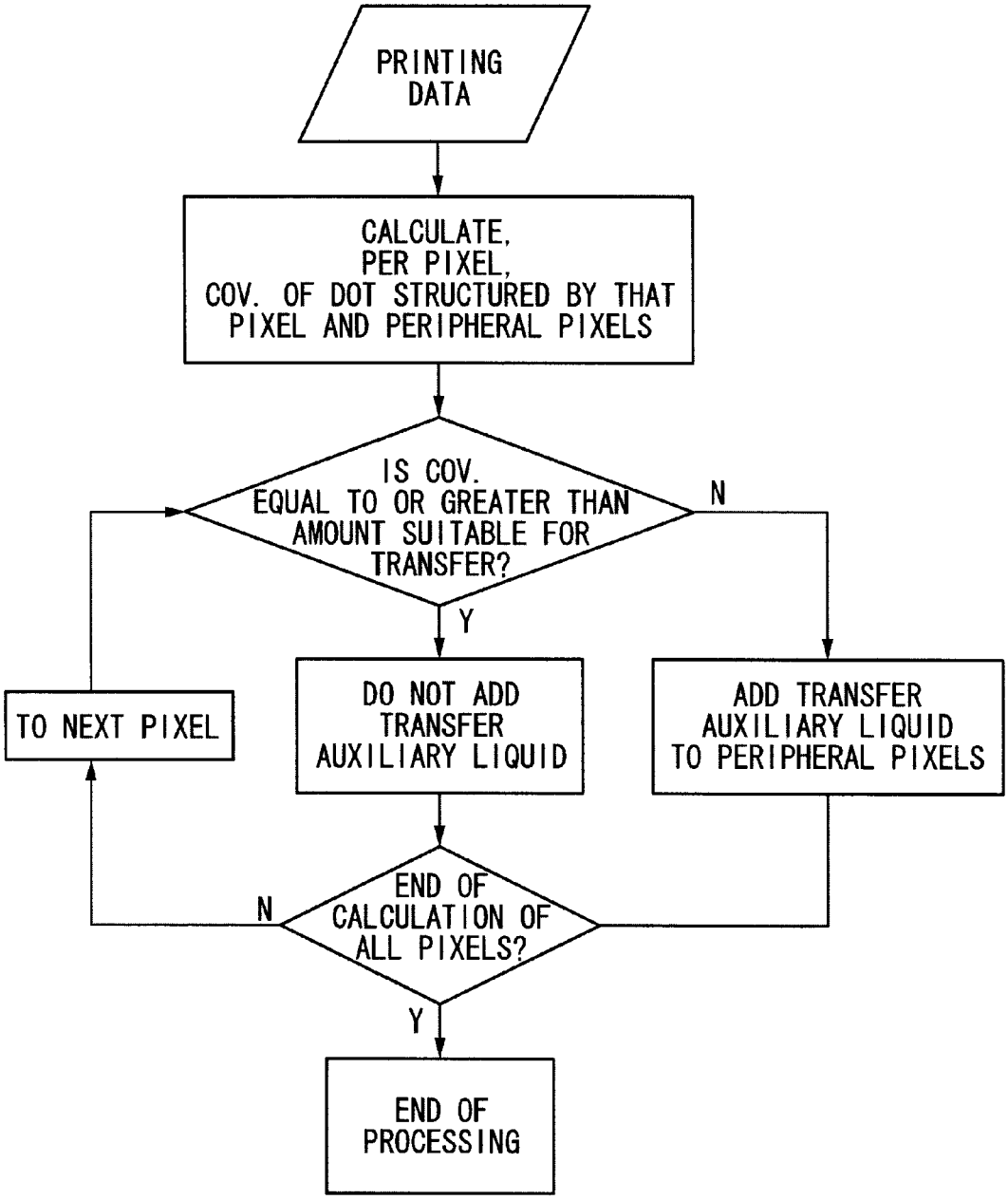
FIG. 6 is a flowchart of transfer auxiliary liquid ejection determination in image formation pertaining to the second exemplary embodiment of the invention.

Thus, in accordance with the procedure shown in the flowchart in FIG. 6, as shown in FIG. 5B, B-2, in regard to a dot where tackiness is insufficient with only one pixel (a dot which is judged as "insufficient Cov. (coverage) dot"), the auxiliary liquid droplet ejecting head 21 ejects the auxiliary liquid droplets 21A onto peripheral pixels to make the dot overall into a dot that is configured by 3×3 pixels, so that the tackiness can be raised to the transfer OK region in FIG. 5A. Thus, occurrences of transfer unevenness/voids can be suppressed.

Third Exemplary Embodiment

As mentioned before, in the image forming method pertaining to the first exemplary embodiment of the present invention, tackiness that is sufficient for transfer is ensured by making the amounts of moisture of dots where the liquid droplets 20A (ink) have been ejected the same. In this case, correction to make the amounts of moisture the same between a dot where the liquid droplet 20A (ink) is ejected and peripheral dots where the liquid droplets 20A are not ejected is not performed.

In a third exemplary embodiment of the present invention, in addition to the above-described exemplary embodiment, the amounts of moisture that the liquid receiving particles 16 absorb are made constant between a dot where the liquid droplet 20A (ink) is ejected and peripheral dots where the liquid droplets 20A are not ejected, whereby transfer characteristics of the image formation surface overall can be further made uniform.

Figures 7A, 7B:
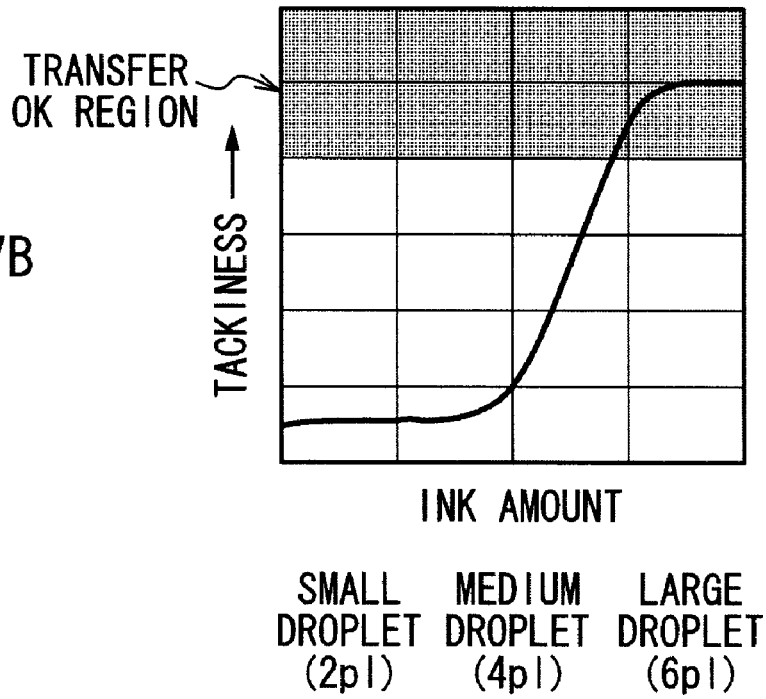
FIG. 7A and FIG. 7B are a chart and a graph showing the relationship between liquid amounts of liquid droplets and tackiness in image formation pertaining to a third exemplary embodiment of the invention.

That is, as shown in FIG. 7B, in a case where tackiness that becomes OK (good) for transfer can be ensured when the liquid amount of the liquid droplet 20A is large droplet (6 pl), as shown in FIG. 7A, a large droplet (6 pl) of the auxiliary liquid droplet 21A is ejected with respect to a dot where the liquid droplet 20A (ink) is not ejected, to make the moisture amount 6 pl in the dot overall.

Figure 8:
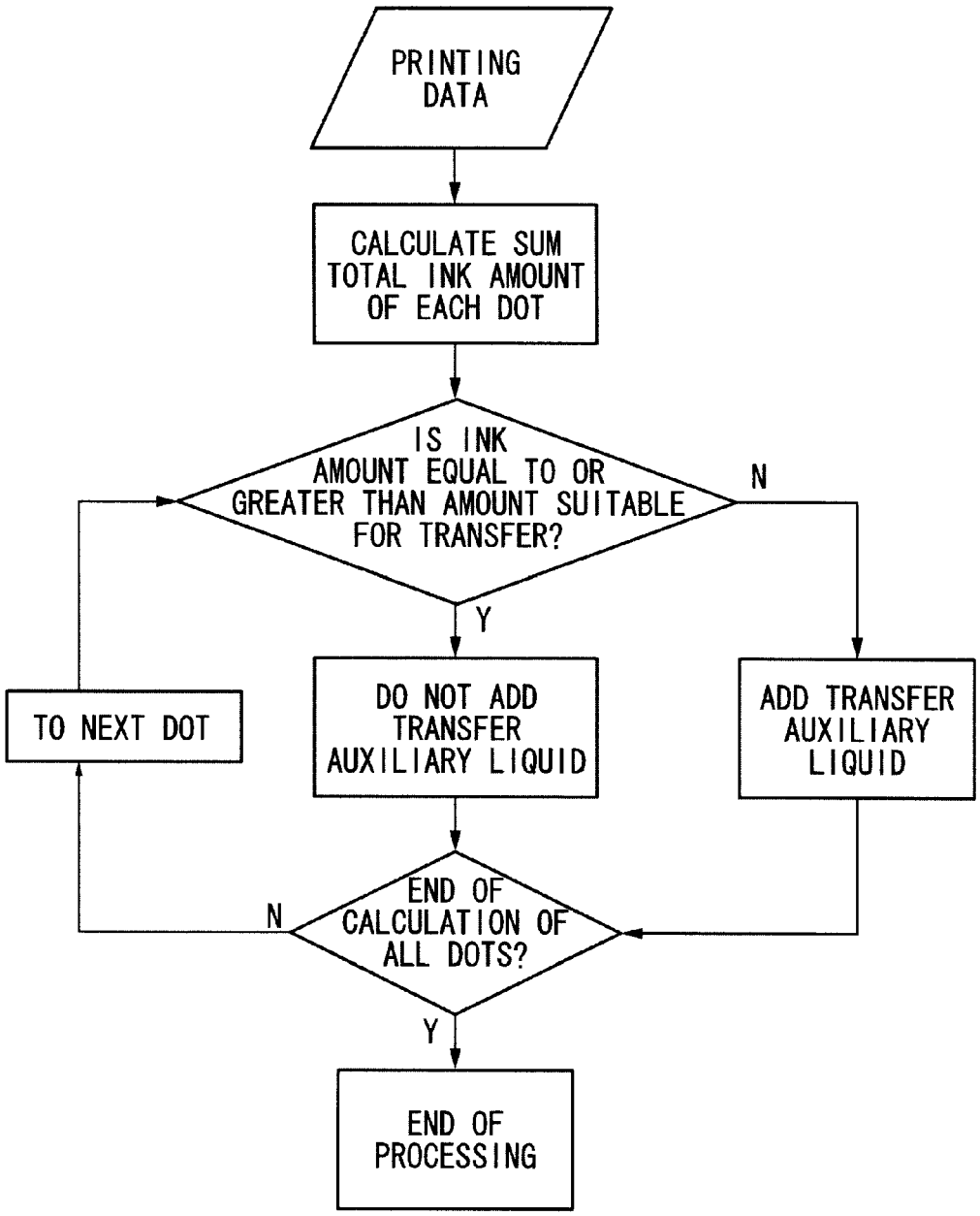
FIG. 8 is a flowchart showing transfer auxiliary liquid amount calculation in image formation pertaining to the third exemplary embodiment of the invention.

Below, similarly, in accordance with the procedure shown by the flowchart in FIG. 8, control is performed such that, when the liquid droplet 20A is a small droplet (2 pl), then a medium droplet (4 pl) of the auxiliary liquid droplet 21A is ejected, and when the liquid droplet 20A is a medium droplet (4 pl), then a small droplet (2 pl) of the auxiliary liquid droplet 21A is ejected, and when the liquid droplet 20A is a large droplet (6 pl), then the auxiliary liquid droplet 21A is not ejected, so that regardless of whether or not the liquid droplet 20A is ejected or not ejected, the liquid receiving particles 16 can always ensure an absorbed moisture amount of 6 pl per dot.

Thus, transfer characteristics become uniform in the image formation region overall, and the surface of the image that has been transferred can be made smooth/uniform. For this reason, an excellent effect can be expected when one wishes to impart gloss to the surface.

Fourth Exemplary Embodiment

As mentioned above, in the image forming method pertaining to the third exemplary embodiment of the present invention, the amounts of moisture that the liquid receiving particles 16 absorb are made constant between a dot where the liquid droplet 20A (ink) is not ejected and peripheral dots where the liquid droplets 20A are not ejected, whereby transfer characteristics of the image formation surface overall can be made uniform. In this case, correction to make the amounts of moisture the same between a dot where the liquid droplet 20A (ink) is ejected and peripheral dots where the liquid droplets 20A are not ejected is performed in each dot unit.

In a fourth exemplary embodiment of the present invention, with respect to the above-described exemplary embodiment, the amounts of moisture that the liquid receiving particles 16 absorb are made equal to or greater than a constant between a dot where the liquid droplet 20A (ink) is ejected and dots where the liquid droplets 20A are not ejected, whereby processing is simplified while holding transfer characteristics of the image formation surface overall uniformly to a certain extent.

That is, in a case where tackiness that becomes OK (good) for transfer can be ensured when the liquid amount of the liquid droplet 20A is large droplet (6 pl), for example, as shown in FIG. 9, a large droplet (6 pl) of the auxiliary liquid droplet 21A is ejected with respect to a dot where the liquid droplet 20A is not ejected, to make the moisture amount 6 pl in the dot overall.

In the present exemplary embodiment, the large droplet (6 pl) of the auxiliary liquid droplet 21A is always ejected whether the liquid amount of the liquid droplet 20A is a small droplet (2 pl), a medium droplet (4 pl) or a large droplet (6 pl). That is, regardless of the liquid amount of the liquid droplet 20A that is ejected, a constant amount (here, 6 pl) of the auxiliary liquid droplet 21A is always ejected to ensure a liquid amount equal to or greater than 6 pl in all dots.

Thus, tackiness that is necessary for transfer is ensured in all dots, the process of calculating the liquid amount of the auxiliary liquid droplet 21A that is to be ejected per dot can be omitted on the other hand, and therefore the processing speed of the image forming apparatus 10 overall can be improved.

In the present exemplary embodiment, the auxiliary liquid droplet 21A is given a constant liquid amount in the image formation surface overall, so it is not necessary to control in dot unit the auxiliary liquid droplet ejection head 21 that ejects the auxiliary liquid droplet 21A and, for example, a method of spraying with a nozzle that sprays the auxiliary liquid droplet 21A on the entire surface is possible.

Fifth Exemplary Embodiment

As mentioned above, in the image forming method pertaining to the first exemplary embodiment of the present invention, depending on the liquid amount of the liquid droplet 20A, the image forming apparatus 10 performs control to eject the auxiliary liquid droplet 21A, the liquid droplet 20A is ejected on the same dot to thereby maintain the liquid amount of the dot overall equal to or greater than a constant such that the liquid receiving particles 16 absorb a sufficient amount of moisture.

On the other hand, a method already exists which reproduces a dot whose color is fainter than a color of a small droplet of the liquid droplet 20A, by reducing the amount of the recording material such as the pigment that is included in the liquid droplet 20A and using it as so-called pale ink together with the liquid droplet 20A, by ejecting the pale ink (P ink) liquid droplet 20PA.

In a fifth exemplary embodiment of the present invention, the above-described method is utilized to reproduce 256 gradations with densities of 0 to 255, for example, by the liquid droplets 20A and 20PA while the moisture amount per dot can be held at a constant.

That is, as shown in FIG. 10, the image forming apparatus 10 performs control such that, with image information 0 (no color), neither the liquid droplet 20A (ink) nor the liquid droplet 20PA (pale ink) is ejected, and with image information 1 to 31, just a medium droplet (4 pl) of the liquid droplet 20PA is ejected, and with image information 32 to 63, just a large droplet (6 pl) of the liquid droplet 20PA is ejected, and with image information 64 to 95, a small droplet (2 pl) of the liquid droplet 20A and a small droplet (2 pl) the liquid droplet 20PA are ejected, whereby the amount of moisture that the liquid receiving particles 16 absorb can be made equal to or greater than a constant value such that the total amount becomes equal to or greater than 4 pl in combination with the liquid droplet 20PA (pale ink) even in a dot where the liquid droplet 20A is a small droplet (2 pl).

Thus, the image forming apparatus 10 can perform control such that the liquid amount of the dot overall is ensured equal to or greater than a constant, with gradation being maintained, and such that the liquid receiving particles 16 absorb a sufficient amount of moisture. Moreover, in the image forming apparatus 10, the liquid droplet 20PA (pale ink) applied to image formation is used together with the liquid droplet 20A to adjust the moisture amount, so it is not necessary to separately dispose the auxiliary liquid droplet ejecting head 21, and the number of parts can be reduced.

Further, here, the liquid amount 4 pl is ensured in all dots excluding a dot whose image information is 0, but the exemplary embodiment may also be configured to hold the liquid amount 6 pl or greater in accordance with the surface property and the like of the recording medium 8.

<Evaluation Results>

In FIG. 11, there are shown results when, in the image forming methods pertaining to the first to fifth exemplary embodiments of the present invention, transfer efficiency is compared with a conventional example.

The surface of the intermediate transfer member 12 after an image is transferred to the recording medium 8 is read by a scanner, digitalization is performed, and the rate of dots that are not transferred is used to define a occurrence rate X of transfer defects. When X=0%, then a mark of "○" is given, and when $0<X\leqq 10\%$, then a mark of "Δ+" is given, and when $10<X\leqq 20\%$, then a mark of "Δ" is given, and when $20\leqq X$ %, then a mark of "x" is given.

As the recording medium 8, art paper whose surface is the smoothest, C2 paper (high-quality paper) that has intermediate (normal) smoothness, and, as a reference, Leathek 66 whose surface is rough are compared. In the conventional example, with the art paper whose transferability is x, the results of all are ○ without problem, and with the C2 paper (high-quality paper), the results are Δ in just the first and fifth exemplary embodiments.

In the systems that make the liquid amount per dot equal to or greater than a constant or ejects the auxiliary liquid droplet 21A onto the entire surface as in the second, third, fourth exemplary embodiments, transferability is ○ even with the Leathek 66.

Other Exemplary Embodiments

Modes of implementing the present invention have been described above by way of exemplary embodiments, but these exemplary embodiments are only examples and can be variously altered and implemented within a range that does not depart from the gist. Further, the scope of rights of the present invention is not limited to these exemplary embodiments, and it goes without saying that the present invention can be implemented in various aspects in a range that does not depart from the gist of the present invention.

That is, in each of the above mentioned exemplary embodiments, the liquid droplets 20A are ejected on the basis of image data from the liquid droplet ejecting heads 20 of each of the colors of black, yellow, magenta and cyan such that a full color image is recorded on the recording medium 8, but the present invention is not limited to the recording of a character and an images on a recording medium. That is, the liquid droplet ejecting apparatus pertaining to the present invention can be applied with respect to all industrially used liquid droplet ejecting (jetting) apparatus.

Figure 12:
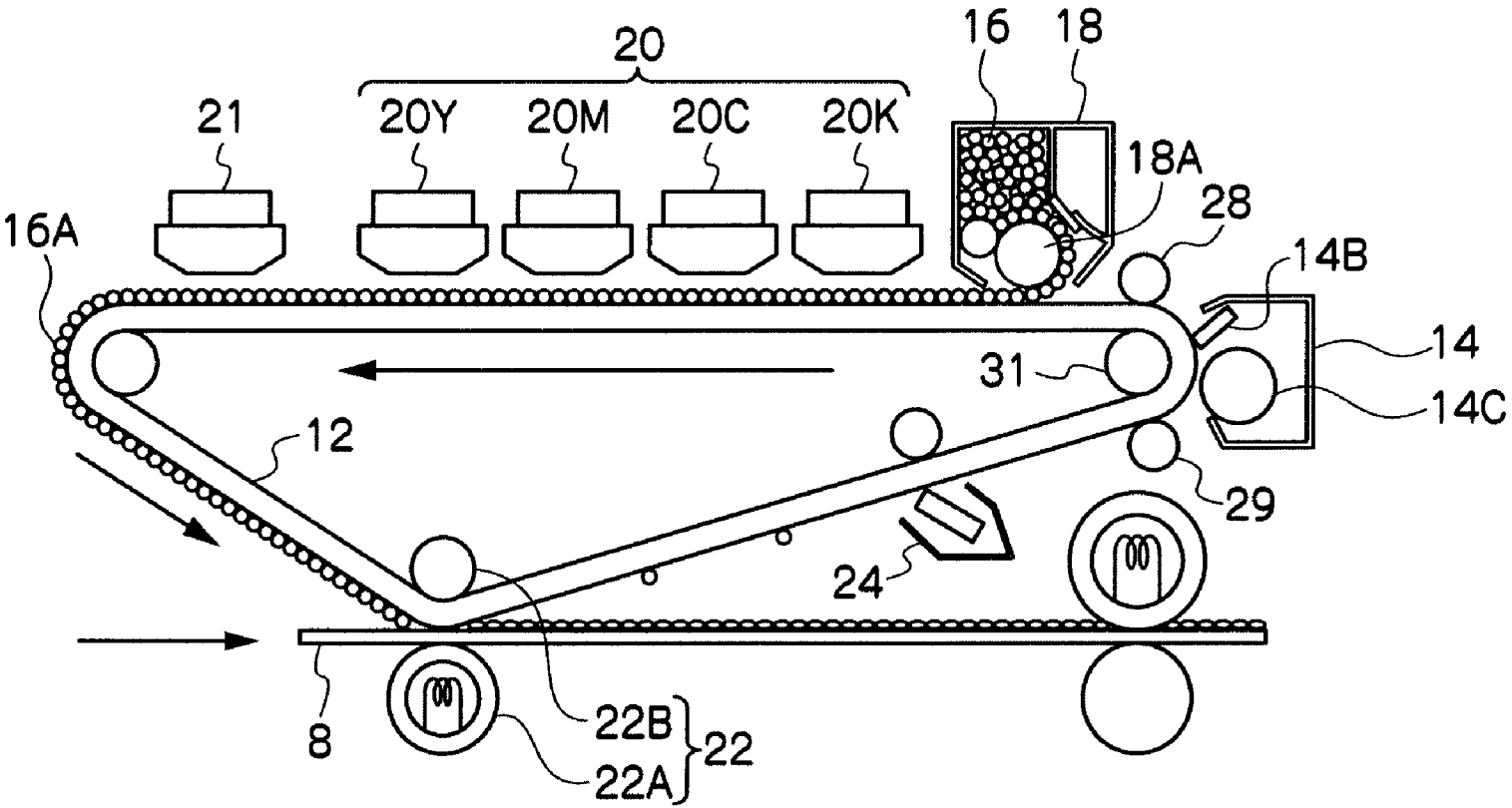
FIG. 12 is a conceptual drawing showing another exemplary embodiment of the image forming apparatus pertaining to the invention.
Figure 13:
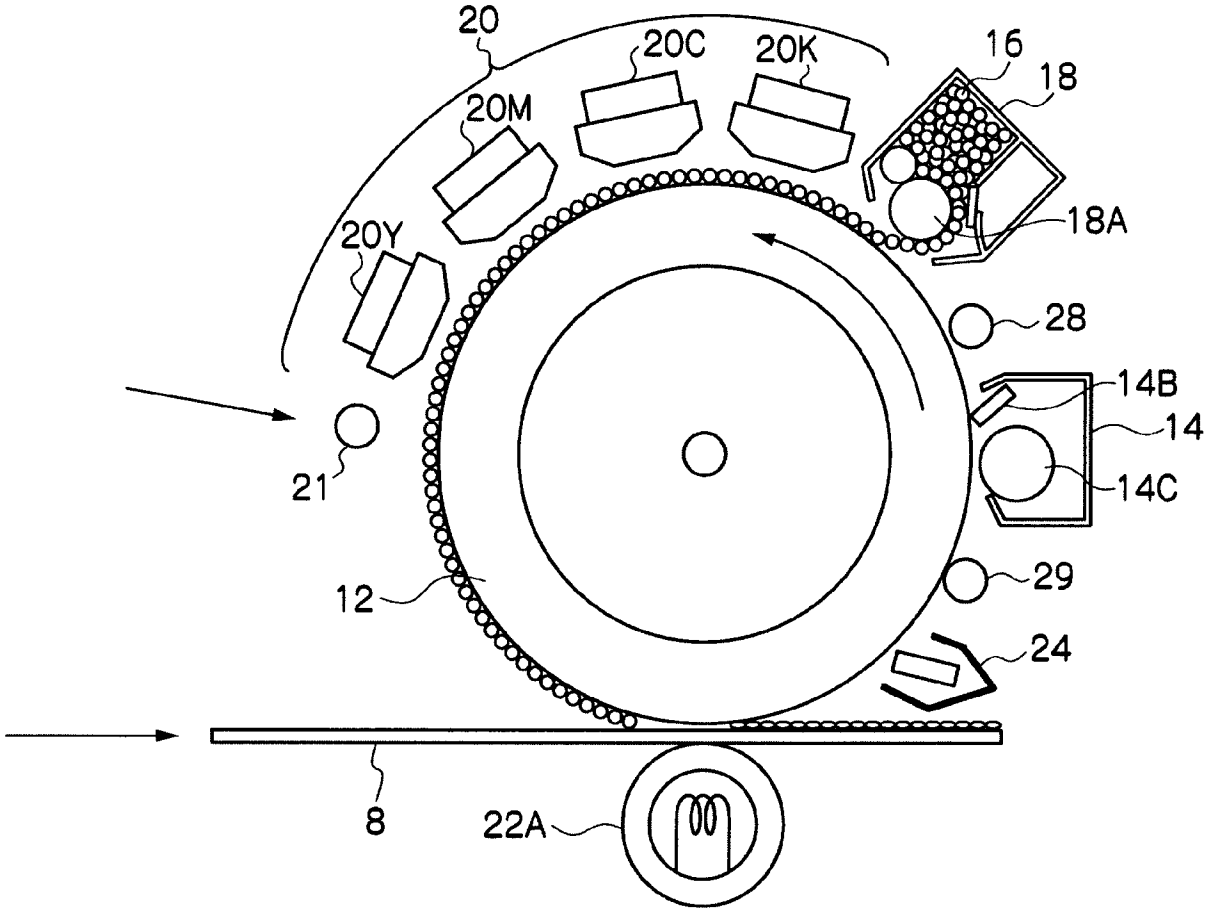
FIG. 13 is a conceptual drawing showing another exemplary embodiment of the image forming apparatus pertaining to the invention.

Further, the position of the auxiliary liquid droplet ejecting head 21 may, as shown in FIG. 12, be on the downstream side of the liquid droplet ejecting heads 20 such that the auxiliary liquid droplet ejecting head 21 performs ejection of the auxiliary liquid droplet 21A after image formation by the liquid droplets 20A has ended. Alternatively, as shown in FIG. 13, the intermediate transfer member 12 may be given a hollow drum shape rather than a belt-like shape.

What is claimed is:

1. An image forming method comprising:

forming a liquid receiving particle layer on an intermediate transfer member using a liquid receiving particle that is capable of receiving a recording liquid including a recording material;

forming an image of the recording material on a surface of the liquid receiving particle layer by applying a liquid droplet of the recording liquid to the liquid receiving particle layer on the basis of image data and holding the recording material on the surface of the liquid receiving particle layer on the intermediate transfer member;

applying a transfer auxiliary liquid in at least a portion of a formation range of the image; and transferring the liquid receiving particle layer to which the recording liquid is applied to a transfer receiving member from the intermediate transfer member, such that the image is interposed between the transfer receiving member and the liquid receiving particle layer.

2. The image forming method of claim 1, wherein an ejection amount of the transfer auxiliary liquid is calculated in dot unit of the image in accordance with an ejection amount of the liquid droplet.

3. The image forming method of claim 1, wherein an ejection amount of the transfer auxiliary liquid is calculated in ejection area unit of the image in accordance with an ejection amount of the liquid droplet.

4. The image forming method of claim 1, wherein a total amount of an ejection amount of the liquid droplet and an ejection amount of the transfer auxiliary liquid is a constant amount or greater in each of dots of the image in the formation range of the image.

5. The image forming method of claim 1, wherein an ejection amount of the transfer auxiliary liquid is a constant amount in each of dots of the image in the formation range of the image.

6. The image forming method of claim 1, wherein the transfer auxiliary liquid is a pale ink.

7. An image forming apparatus comprising:

an intermediate transfer member;

a particle supply unit that supplies, to the intermediate transfer member, a liquid receiving particle that is capable of receiving a recording liquid including a recording material and is capable of holding the recording material on a surface thereof to form a liquid receiving particle layer;

a liquid droplet ejection unit that applies a liquid droplet of the recording liquid to the liquid receiving particle layer on the basis of image data to form an image of the recording material on a surface of the liquid receiving particle layer;

a transfer unit that transfers the liquid receiving particle layer to which the recording liquid is applied to a transfer receiving member such that the image is interposed between the transfer receiving member and the liquid receiving particle layer; and a transfer auxiliary liquid ejection unit that applies a transfer auxiliary liquid in at least a portion of a formation range of the image.

8. The image forming apparatus of claim 7, wherein an ejection amount of the transfer auxiliary liquid is calculated in dot unit of the image in accordance with an ejection amount of the liquid droplet.

9. The image forming apparatus of claim 7, wherein an ejection amount of the transfer auxiliary liquid is calculated in ejection area unit of the image in accordance with an ejection amount of the liquid droplet.

10. The image forming apparatus of claim 7, wherein a total amount of an ejection amount of the liquid droplet and an ejection amount of the transfer auxiliary liquid is a constant amount or greater in each of dots of the image in the formation range of the image.

11. The image forming apparatus of claim 7, wherein an ejection amount of the transfer auxiliary liquid is a constant amount in each of dots of the image in the formation range of the image.

12. The image forming apparatus of claim 7, wherein the transfer auxiliary liquid is a pale ink.

13. The image forming method of claim 6, wherein a total amount of an ejection amount of the liquid droplet and an ejection amount of the pale ink is a constant amount or greater in each of dots of the image in the formation range of the image.

14. The image forming apparatus of claim 12, wherein a total amount of an ejection amount of the liquid droplet and an ejection amount of the pale ink is a constant amount or greater in each of dots of the image in the formation range of the image.

* * * * *